US006360768B1

(12) United States Patent
Galler

(10) Patent No.: US 6,360,768 B1
(45) Date of Patent: Mar. 26, 2002

(54) CONTROL APPARATUS FOR PNEUMATIC EVACUATION AND WATER VALVES, OPERATED BY VACUUM PRESSURE

(75) Inventor: Lothar Galler, Hammersbach (DE)

(73) Assignee: Roediger Anlagenbau-Gmbh, Hanau (DE)

( * ) Notice: Subject to any disclaimer, the term of this patent is extended or adjusted under 35 U.S.C. 154(b) by 0 days.

(21) Appl. No.: 08/909,925

(22) Filed: Aug. 12, 1997

(30) Foreign Application Priority Data

Aug. 17, 1996 (DE) ..... 196 33 178

(51) Int. Cl.[7] ..... E03C 1/12; E03D 5/09

(52) U.S. Cl. ..... 137/205; 4/323; 4/431; 4/434; 137/236.1; 137/907; 141/65; 251/41; 251/65

(58) Field of Search ..... 137/205, 236.1, 137/410, 413, 414, 907; 4/300, 316, 431, 434, 435, 323; 251/25, 28, 41; 141/65; 406/1, 50, 192

(56) References Cited

U.S. PATENT DOCUMENTS 3,695,288 A * 10/1972 Billeter et al. ..... 251/41
3,720,962 A * 3/1973 Harrah ..... 4/431
4,041,554 A * 8/1977 Gregory et al. ..... 4/316
4,357,719 A * 11/1982 Badger et al. ..... 4/431
4,713,847 A * 12/1987 Oldfelt et al. ..... 137/205
5,165,457 A * 11/1992 Olin et al. ..... 137/205
5,214,807 A * 6/1993 Terve ..... 4/431
5,282,281 A * 2/1994 Clear et al. ..... 4/434
5,317,763 A * 6/1994 Frank et al. ..... 4/434
5,495,626 A * 3/1996 Lindroos et al. ..... 4/431
5,588,458 A * 12/1996 Ushitora eet al. ..... 137/205
5,615,701 A * 4/1997 Yamabe et al. ..... 137/205
5,813,061 A * 9/1998 Torngist ..... 4/431
5,871,027 A * 2/1999 Shimizu et al. ..... 137/403

* cited by examiner

*Primary Examiner*—George L. Walton
(74) *Attorney, Agent, or Firm*—Ansel M. Schwartz

(57) ABSTRACT

A control apparatus for pneumatic evacuation and/or water valves, operated by vacuum pressure and used for a vacuum sewerage system, particularly for pneumatically operated sanitary appliances, such as vacuum closets, urinals or wash basins. The control apparatus comprises an activating element, such as a push button, which is integrated in a housing and moved relative to this housing against a force to operate a control valve which comprises a valve disc and a valve piston and transmits vacuum pressure from a vacuum source to the evacuation and water valves. A compact control apparatus is provided which prevents continuous transmittal of vacuum to the evacuation and water valves if the activating element is maloperated. The piston of the control valve is moved by a diaphragm separating a first and a second chamber within the housing. The first chamber is connectable through the first control valve to the evacuation and/or water valves and is connected to the vacuum source. The second chamber is in communication with ambient air when the activating element returns to its original position after having been moved against the force into the housing. A spring element drives the diaphragm towards the second chamber, whereby the diaphragm is moved against the spring force and opens the control valve if the pressure within the first chamber is sufficiently smaller than the pressure within the second chamber. A method for operating a valve.

15 Claims, 1 Drawing Sheet

CONTROL APPARATUS FOR PNEUMATIC EVACUATION AND WATER VALVES, OPERATED BY VACUUM PRESSURE

FIELD OF THE INVENTION

The present invention concerns a control apparatus for pneumatic evacuation and/or water valves, operated by vacuum pressure and used in a vacuum sewerage system, particularly for pneumatically operated sanitary appliances, such as vacuum closets, urinals or wash basins. The control apparatus comprises an activating element, such as a button, which is integrated in a housing and can be moved relative to this housing against a force to operate a control valve comprising a valve disc and a valve piston and transmitting vacuum pressure from a vacuum source to the evacuation and water valves.

BACKGROUND OF THE INVENTION

Control apparatus for pneumatic evacuation and/or water valves are used for example in combination with vacuum closets in boats or trains. Since activating elements and control valves are integrated in separate housings, conduits are required to connect them. Another disadvantage is that evacuation cycles can start even if vacuum strength is not sufficient for efficient evacuation. This results in malfunction of the vacuum sewerage system. In addition, there is the danger that vacuum is continuously transmitted to the evacuation or water valves if the activating element, such as push button, remains in its activating position, e.g. due to malfunction or maloperation.

The present invention addresses these problems and provides a control apparatus of the initially mentioned kind, particularly for sanitary appliances operated by vacuum pressure, which is very compact and prevents continuous transmittal of vacuum to the evacuation and water valves in case of malfunction or maloperation of the activating element. In addition, an evacuation cycle shall be performed only if the vacuum is sufficiently strong. Finally, it shall be able to keep the water valve open longer than the evacuation valve, as is required particularly if used in combination with vacuum closets.

SUMMARY OF THE INVENTION

According to the present invention, the problems are solved by means that the valve piston of the control valve is moved by a diaphragm separating a first and a second chamber within the housing, that the first chamber is connected to the vacuum source and is connectable through the control valve to the evacuation and/or water valves, that the second chamber is connected with atmospheric air after the activating element has been moved against the force into the housing and returned to its original position, and that a spring drives the diaphragm towards the second chamber, whereby the diaphragm is moved against the spring force by a sufficient pressure difference between the second and first chamber and opens the control valve.

The control apparatus, according to the present invention, guarantees that vacuum pressure from the vacuum source is transmitted to the evacuation or water valve only after the activating element has been moved from its first to its second position and returned to its original position. The control valve can be opened for transmittal of vacuum to the evacuation or water valves only if the pressure difference between the second and first chamber is sufficient to move the diaphragm against the spring force. If the difference between atmospheric pressure in the second chamber and vacuum pressure in the first chamber is not sufficient to move the diaphragm against the spring force from its first position, closing the control valve, to its second position, opening the control valve, the first control valve remains closed, and evacuation cannot be performed.

The same applies if the actuating element, e.g. push button, remains jammed in its pressed position. In this case, the second chamber cannot be connected with the atmosphere. The activating element interacts with a control piston sealing a connection between the second chamber and the atmosphere as long as the activating element is pressed against the force into the housing, and is moved by the activating element while this returns to its original position to open the connection between the second chamber and the atmosphere.

In other words, the activating element must be moved from its original position and must return to its original position to open the control valve, to transmit vacuum to the evacuation or water valve, and to open them. The control valve is opened only if the vacuum strength in the second chamber is sufficient for the evacuation procedure.

It is further proposed that the control piston is engaged by the diaphragm and returned to its original position, closing the connection between the atmosphere and the second chamber, while the diaphragm is moved from its first position, closing the control valve, to its second position, opening the control valve. When the connection between the second chamber and the atmosphere is closed, the second chamber is evacuated through a connection between the first and the second chamber. This connection is preferably provided through the valve piston of the control valve.

A spring element, forcing the activating element towards its original position, encompasses the control piston to keep the control apparatus compact.

For further improvement of the control apparatus according to the present invention, a restrictor means is provided interacting with the diaphragm and/or the valve piston of the control valve such that movement of the diaphragm and opening of the control valve can take place only if the vacuum strength is sufficient for evacuation of wastewater through the evacuation valve. In other words, movement of the diaphragm, opening of the control valve and transmittal of vacuum from the first chamber to the evacuation and water valves is restricted to a condition of sufficient vacuum strength. The restrictor means may comprise a magnet located in the second chamber and interacting with a metal plate fixed to the diaphragm. Restricting forces can be adjusted by selection of appropriate magnets and metal plates.

While the first control valve closes the first chamber, ambient air pressure is transmitted through the control valve to the evacuation or water valves and keeps them closed.

The present invention provides an extraordinary compact control apparatus. The activating element, the control piston, the first and second chambers, separated by the diaphragm, and the control valve are arranged in a single cylindrical housing, whereby the activating element is located on its front, while connections for conduits to the vacuum source and the evacuation and water valves are located on its back. The control piston and the valve piston are preferably arranged coaxially with the cylinder axis of the housing.

An orifice is provided on the back of the housing, connects the first chamber with the atmosphere and is closed by the control valve while vacuum is transmitted to the evacuation or water valves.

According to another proposal of the present invention, a throttling means, such as a nozzle, is provided within the conduit to the water valve for delayed closing of the water valve relative to the evacuation valve. By this means, water can be supplied after the evacuation procedure is finished. This is particularly useful for closets and urinals. The present invention also involves a method for controlling the operation of a valve.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
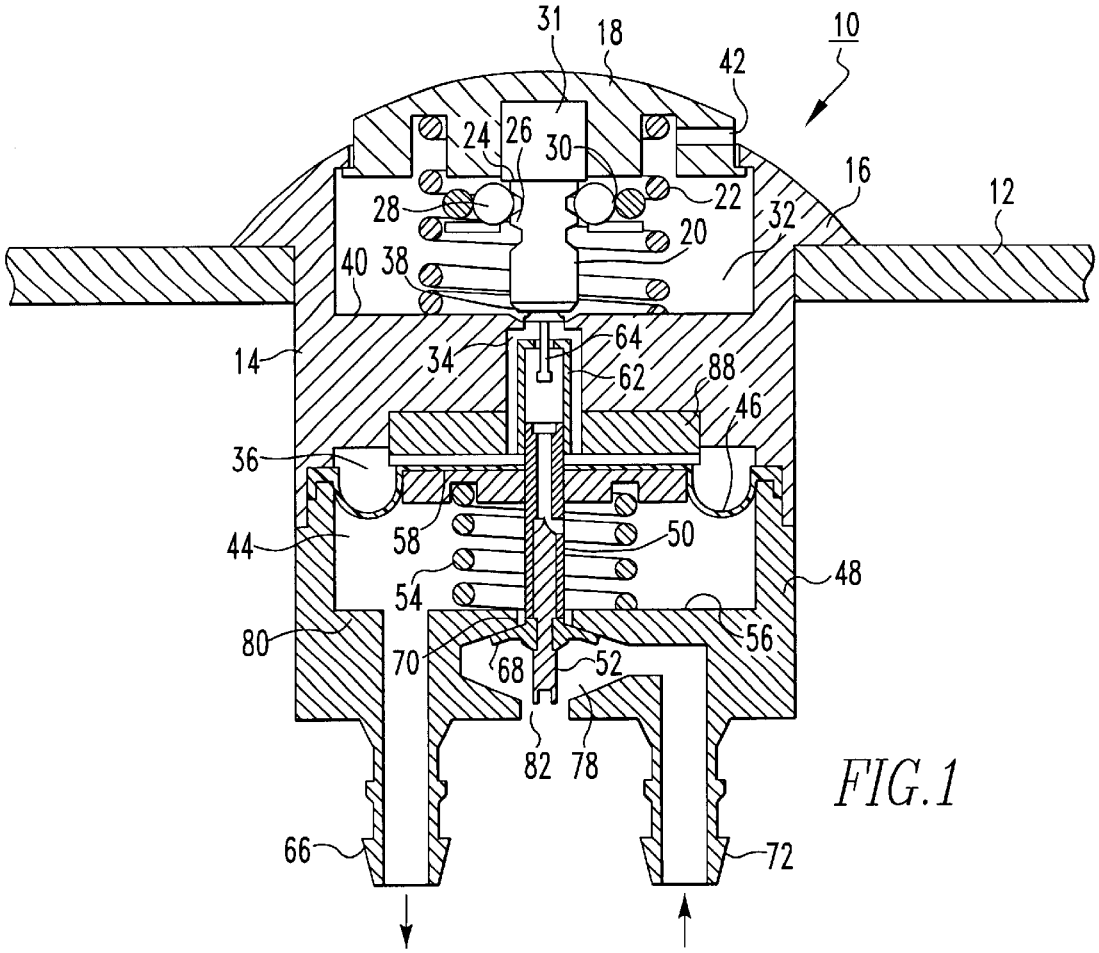
FIG. 1 is a sectional view of a control apparatus for evacuation or water valves operated by vacuum and FIG. 2 is a diagram for the control apparatus of FIG 1.
Figure 2:
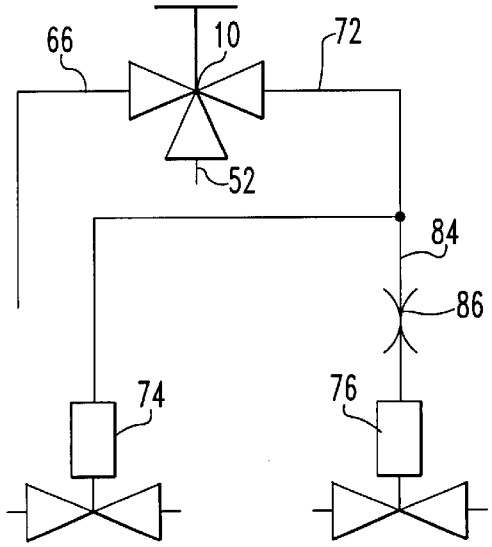

Referring now to the drawings wherein like reference numerals refer to similar or identical parts throughout the several views, and more specifically to FIG. 1 thereof, there is shown a control apparatus 10 for sanitary appliances, such as a vacuum closet. The control apparatus 10 has a cylindrical housing 14 installed in a wall 12. A section 16 of the housing 14 is shaped like a conus section or a mushroom and encompasses a push button 18 as activating element which is moveable along the longitudinal axis of the housing 14. The push button 18 interacts with a control piston 20 arranged coaxially with the longitudinal axis of the housing 14 and interacts with the housing 14 by means of a spring 22 encompassing the control piston 20 and exerting a force between the push button 18 and the housing 14 to drive the push button 18 out of the housing 12.

The control piston 20 comprises circumferential grooves 24, 26 which are located at a distance from each other in the direction of the piston's axis and interact with catch means 28 engaging into the grooves 24, 26, depending on the position of the push button 18. The catch means 28 may consist of e.g. three catch balls or a catch ring encompassed by an elastic holding ring 30, such as an O-ring, driving the catch means into the grooves.

The push button 18 includes an axial recess 31 having a diameter adapted to the diameter of the control piston 20. The control piston 20 is more or less introduced into the recess 31, depending on the positions of the push button 18 and catch means 28.

The housing 14 comprises a cylindrical chamber like recess 32 receiving the push button 18 while pressed into the housing 14. If the push button 18 is pressed, the catch means 28 is disengaged of the upper groove 24 and then engaged to the lower groove 26. While the push button 18 moves down, the control piston 20 remains in its original position relative to the housing 14. After the pressing force has been released, the spring 22 returns the push button 18 to its original upper position and lifts the control piston 20 while this is attached to the push button 18 by the catch means 28. When the control piston 20 is lifted to its upper position, a connection 34 between the recess 32 receiving the push button 18 and a second chamber 36 within the housing 14 is opened. The connection 34 is a bore through a bottom 40 of the recess 32 and had been closed by a seal 38 of the control piston 20. The control piston 20 and its seal 38 form a type of valve.

The recess 32 is connected through a second bore 42 with the atmosphere.

The second chamber 36 is separated by a diaphragm 46 from a first chamber 44 which is located near the bottom of the housing 14. The diaphragm 46 is connected circumferentially with a wall 48 of the housing 14 and centrally with a valve piston 50 of a control valve 52 thus guiding the valve piston 50. A spring 54 encompasses the valve piston 50, is supported by a bottom 56 of the first chamber 44 and exerts an upward force on a plate 58 which is centrally fixed to the diaphragm 46.

The valve piston 50 includes a bore connecting the first chamber 44 and the second chamber 36.

A tappet 62 extends from the center of the diaphragm 46 and interacts with a propagating section 64 of the control piston 20.

A connection 66 connects the first chamber 44 with a vacuum source. An orifice 70 is provided centrally in a bottom 56 of the first chamber 44, is closeable by a valve disc 68 of the control valve 52 and leads to a connection 72 to an evacuation valve 74 and a water valve 76.

The connection 72 and the orifice 70 which is closeable by the first control valve 52 are both connected with a third chamber 78 located at the bottom 80 of the housing 14. The chamber 78 comprises a further orifice 82. The orifice 82 is either open to the atmosphere or closed by the valve disc 68, depending on the position of the control valve 52.

The function of the control apparatus according to the present invention is as follows. FIG. 1 shows the control apparatus in a condition transmitting vacuum through the connection 66 to the first chamber 44 and through a bore within the valve piston 50 to the second chamber 36, which is separated from the first chamber 44 by the diaphragm 46. Atmospheric pressure is transmitted through the connection 42 to the recess 32 which receives the push button 18, but cannot be transmitted to the second chamber 36 while the connection 34 is closed by the seal 38 of control piston 20. While the push button 18 is pressed into the housing 14, the connection 34 between the recess 32 and the second chamber 36 remains closed, as described above. After the push button 18 is released and lifted together with the catch means 28 and the control piston 20, atmospheric pressure is transmitted from the recess 32 through the now open connection 34 to the second chamber 36. The control valve 52 is still in its upper position closing the connection between the first chamber 44 and the evacuation valve 74 and the water valve 76. If the vacuum in the first chamber 44 is sufficiently strong, the pressure difference between the atmospheric pressure in the second chamber 36 and the vacuum pressure in the first chamber 44 can overcome the force of the spring 54 and can move the diaphragm 46, its plate 58 and therewith the control valve 52 to a lower position closer to the bottom 56 of the first chamber 44. The orifice 70 within the bottom 56 of the first chamber 44 is opened, and the orifice 82 connecting the chamber 78 to the atmosphere is closed by the valve disc 68. As a consequence, vacuum pressure is transmitted through connection 72 to the evacuation valve 74 and the water valve 76 and opens these to allow for evacuation of sewage and water flushing.

Abrupt switching of the diaphragm 46 and therewith of the first control valve 52 from their upper to their lower position is performed by providing a restrictor mechanism, such as a magnet 88 in the second chamber 36 and the metallic plate 58. The magnet 88 keeps the metallic plate 58 of the diaphragm 46 in its upper position and releases them abruptly when the vacuum strength in the chamber 44 is sufficient to overcome the sum of the forces exerted by the spring 54 and the magnet 88.

Abrupt backswitching of the diaphragm 46 occurs, when the pressure in the second chamber 36 rises and approaches atmospheric pressure.

While the diaphragm 46 is switched from its upper to its lower position, the tappet 62 engages the section 64 and pulls the control piston 20 down, with the consequences that the catch means 28 disengages of the lower groove 26 and engages the upper groove 24, and the seal 38 closes the connection 34 to the second chamber 36. The second chamber 36 is now evacuated through the adjustable bore within the valve piston 50. As soon as the pressure difference between the second chamber 36 and the first camber 44 is no longer sufficient to maintain the diaphragm 46 in its lower position, the spring 54 switches the diaphragm 46 back from its lower to its upper position (which is shown in FIG. 1). In this moment, the control valve 52 closes the orifice 70 and opens the orifice 82 to the atmosphere thus atmospheric pressure is transmitted through connection 72 to both the evacuation valve 74 and the water valve 76 closing them. An adjustable nozzle 86 is provided in a conduit 84 between the connection 72 and the water valve 76 to delay transmittal of atmospheric pressure. The water valve 76 is closed after the evacuation valve 74. The opening periods of the valves 74, 76 are variable by adjusting sizes of the bore through the valve piston 20 and of the nozzle 86.

The control apparatus 10 according to the present invention is very compact and guarantees that the evacuation and water valves 74, 76 are opened only if the push button 18 works properly. In addition, the controller 10 stores the signal, provided by pressing the push button: The control piston 20 can return to its original position and close the connection between the second chamber 36 and the atmosphere only after a sufficiently strong vacuum in the first chamber 44 has switched the diaphragm 46 from its upper to its lower position. The control apparatus according to the present invention opens the evacuation and water valves 74, 76 only if vacuum of sufficient strength is transmitted to connection 66.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A control apparatus for pneumatically operating at least one of an evacuation valve or a water valve in a vacuum sewerage system, particularly for use in sanitary appliances, such as closets, urinals or wash basins, which are operated by vacuum, comprising:

a housing including an activating element which is movable from an original position against a force relative to the housing to an activated position;

a three-way control valve being disposed in the housing and comprising a valve piston and a valve disc, said control valve being operated by the activating element and transmitting vacuum from a vacuum source to the at least one of the evacuation valve or water valve while being open, the control valve being disposed in the housing and transmitting atmospheric pressure to the at least one of the evacuation valve or water valve while being closed;

a first chamber being disposed in the housing and connected to the vacuum source and connectable to the at least one of the evacuation valve or water valve through the control valve, the first chamber disposed in the housing;

a second chamber being disposed in the housing and in communication with atmospheric pressure when the activating element has been activated by returning to its original position after having been moved against the force into the housing, the control valve interacting with the activating element via said valve piston such that the second chamber is sealed from the atmosphere when the control valve opens, at least one of the housing or the valve piston includes a bore connecting the first chamber and die second chamber so that vacuum is continuously drawing air through the bore from the second chamber to the first chamber and creating a similar pressure in the first and second chambers when the activating element is in its original position and a differential pressure between the first and second chambers causing the three-way control valve to be moved to an activated position only when the vacuum pressure in the first chamber exceeds a predetermined value when the activating element has been activated;

a diaphragm disposed in the housing separating the first chamber from the second chamber and being moveable for driving the valve piston of the control valve; and a spring element disposed in the housing exerting a force on the diaphragm driving it towards the second chamber, whereby the diaphragm is moved against the spring force and opens the control valve only when the pressure differential force acting on the diaphragm and resulting from a pressure difference between the second chamber and the first chamber is stronger than the spring force whereby, when the control valve is open and is in the activated position, the first chamber connects the vacuum source to the at least one of the evacuation valve or the water valve and when the control valve is closed and the activating element is back in its original position, atmospheric pressure is transmitted to the at least one of the evacuation valve or the vacuum valve to cause deactivation of the at least one of the evacuation valve or the vacuum valve.

2. A control apparatus as described in claim 1 comprising a control piston which interacts with the activating element such that it remains in a first position sealing the second chamber from the atmosphere while the activating element is moved against the force into the housing and is moved to a second position opening a connection between the second chamber and the atmosphere while the activating element returns to its original position.

3. A control apparatus as described in claim 2 wherein the diaphragm drives the control piston back from its second to its first position while the diaphragm moves from a first position closing the first control valve to a second position opening the first control valve.

4. A control apparatus as described in claim 2 comprising a spring element which encompasses the control piston and produces a restoring force acting on the activating element to move the activating element back to its original position.

5. A control apparatus as described in claim 1 comprising an open connection between the first and second chamber through the valve piston of the control valve.

6. A control apparatus as described in claim 2 comprising a tappet extending from the diaphragm and returning the control piston from its second to its first position while the diaphragm moves from a first position closing the control valve to a second position opening the control valve.

7. A control apparatus as described in claim 2 wherein the activating element, the control piston, the first chamber, the second chamber, the diaphragm and the control valve are included in the housing which comprises connections for conduits to source and to the evacuation value.

8. A control apparatus as described in claim 2 wherein the control piston and the valve piston are arranged coaxially with a central axis of the housing.

9. A control apparatus as described in claim 7 comprising a conduit between the connection and a water valve, whereby the conduit is provided with a throttling element which delays closure of the water valve.

10. A control apparatus as described in claim 1 wherein the activating element is a push button.

11. A control apparatus as described in claim 1 wherein said housing includes said first and said second chamber with said valve piston and said valve disc and said diaphragm and connections to the vacuum source and to the evacuation and water valves.

12. A control apparatus as described in claim 1 including latching means disposed in the housing to position the control valve in a closed position until vacuum is sufficient to unlatch the latching means.

13. A control apparatus as described in claim 12 wherein the latching means interacts with the diaphragm such that the diaphragm is moved from a first position closing the control valve to a second position opening the control valve only if a vacuum of sufficient strength is available for evacuation of wastewater through the evacuation valve.

14. A control apparatus as described in claim 13 wherein the latching means comprises a magnet and a metal plate, one of which is attached to the diaphragm and the other is connected to the housing, the magnet and the metal plate being in close contact and thus attracting each other when the control valve is in its closed position.

15. A method for controlling operation of a valve in a vacuum sewage system comprising the steps of:

inducing a vacuum in a first chamber in a housing;

moving an activating element in the housing from an original position;

opening a second chamber of the housing to atmospheric pressure upon the activating element returning to its original position, said second chamber being located adjacent to the first chamber;

applying a pressure difference on a diaphragm between the first and second chamber by the atmospheric pressure entering the second chamber and the vacuum pressure being drawn on the first chamber;

holding a control valve in the housing in a closed position by a selective latching force while vacuum in the first chamber is insufficient to overcome the latching force;

overcoming the latching force when pressure difference between the second chamber and the first chamber overcomes the latching force for moving the diaphragm and opening the control valve;

transmitting vacuum from the first chamber to at least one of an evacuation valve or a water valve and opening at least one of the evacuation valve or the water valve to allow evacuation of wastewater from or the water valve to allow water flow to a sanitary appliance;

closing the second chamber to atmospheric pressure and evacuating the second chamber through a bore connecting the first chamber with the second chamber so that air is continuously drawn through the bore from the second chamber to the first chamber creating a similar pressure in the first and second chambers upon closure of the second chamber to atmospheric pressure, thus reducing the pressure difference between the first and second chambers irregardless of the position of the activating element;

returning the diaphragm to its original position; and closing the control valve which closes the first chamber and transmits atmospheric pressure to the at least of the evacuation valve or the water valve, thus closing the at least one of the evaculation valve or the water valve.

* * * * *